US006012256A

United States Patent [19]

Aschheim

[11] Patent Number: 6,012,256

[45] **Date of Patent: *Jan. 11, 2000**

[54] MOMENT-RESISTANT STRUCTURE, SUSTAINER AND METHOD OF RESISTING EPISODIC LOADS

[75] Inventor: Mark Amos Aschheim, Urbana, Ill.

[73] Assignee: Programmatic Structures Inc., Urbana, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/927,574

[22] Filed: Sep. 6, 1997

Related U.S. Application Data

[60] Provisional application No. 60/023,325, Sep. 11, 1996.

[51] Int. Cl.[7] ..... E04C 3/08; E04H 9/02

[52] U.S. Cl. ..... 52/167.1; 52/650.1; 52/653.1; 52/573.1; 52/736.2; 52/729.1; 52/737.1; 52/741.3

[58] Field of Search ..... 52/167.1, 167.3, 52/633, 634, 636, 650.1, 650.2, 653.1, 653.2, 655.1, 573.1, 263, 283, 726.1, 726.3, 729.1, 729.2, 729.3, 729.5, 730.1, 731.1, 731.2, 732.1, 732.3, 736.1, 737.1, 737.2, 737.6, 736.2, 745.17, 745.18, 741.3

[56] References Cited

U.S. PATENT DOCUMENTS

| | | | |
|---|---|---|---|
| Re. 22,905 | 8/1947 | Scheyer | 189/36 |
| 669,639 | 3/1901 | Hessel et al. | 52/729.1 |

(List continued on next page.)

FOREIGN PATENT DOCUMENTS

| | | | |
|---|---|---|---|
| 645908 | 3/1964 | Belgium . | |
| 337120 | 10/1989 | European Pat. Off. | 52/729.2 |
| 4-169665 | 6/1992 | Japan . | |
| 5-156841 | 6/1993 | Japan . | |
| 6-264499 | 9/1994 | Japan | 52/726.1 |
| 6-288005 | 10/1994 | Japan | 52/736.1 |
| 6-313334 | 11/1994 | Japan | 52/736.2 |
| 1278-420 | 12/1986 | U.S.S.R. . | |
| 2131849 | 6/1984 | United Kingdom | 52/731.2 |

OTHER PUBLICATIONS

Chen, Sheng–Jin, and Lin, Hsin–Yi, "Stress Concentration and Fracture of Steel Beam–To–Column Moment Connection," The Chinese Journal of Mechanics, vol. 6, No. 2, Dec. 1990.

(List continued on next page.)

*Primary Examiner*—Laura A. Callo
*Attorney, Agent, or Firm*—Lila B. Glaser; Philip L. Bateman

[57] ABSTRACT

The present invention relates to a moment-resistant structure, sustainer, and method of construction for deformably resisting episodic loads, particularly those of high intensity. The episodic loads may be due to earthquake, impact, or other intense episodic sources. The structure and sustainer may be in buildings, bridges, or other civil works, land vehicles, watercraft, aircraft, spacecraft, machinery, or other structural systems or apparati. Deformation capacity is enhanced by the use of multiple dissipative zones. Dissipative zones that function in a manner similar to plastic hinges are determined by one or more voids that are located in the web of a sustainer. The one or more voids are of a size, shape, and configuration to assure that the dissipative zones deform inelastically when a critical stress, i.e., a maximum allowable demand, is reached, thereby developing the action of a structural fuse, preventing the occurrence of stress and strain demands sufficient to cause fracture of the connection welds or adjacent heat-affected zones, i.e., preventing the stress and strain demands from exceeding the strength capacity of the connection welds or adjacent heat-affected zones. The sustainers may be removably connected to the remainder of the structure, facilitating their replacement after inelastic deformation. The structure, sustainer, and method of construction may be utilized in new construction and in the rehabilitation of existing construction. Mechanical equipment and utilities may pass through the voids.

16 Claims, 10 Drawing Sheets

U.S. PATENT DOCUMENTS

| | | | |
|---|---|---|---|
| 1,644,940 | 10/1927 | Moyer | 52/634 X |
| 1,656,810 | 1/1928 | Arnstein | 52/634 X |
| 1,682,202 | 8/1928 | Vaughn | 52/636 |
| 1,725,439 | 8/1929 | Carns . | |
| 1,818,418 | 8/1931 | Millard . | |
| 2,085,472 | 6/1937 | Roush | 52/376 |
| 2,098,676 | 11/1937 | Rafter | 52/636 |
| 2,616,529 | 11/1952 | Macdonald | 189/1 |
| 2,941,635 | 6/1960 | Harris | 52/634 |
| 3,050,831 | 8/1962 | Diamond | 52/636 X |
| 3,141,531 | 7/1964 | Montgomery | 52/634 |
| 3,283,464 | 11/1966 | Litzka | 52/636 |
| 3,323,263 | 6/1967 | Adams | 52/223.8 |
| 3,716,959 | 2/1973 | Bernardi . | |
| 4,091,594 | 5/1978 | Yamashita | 52/737.2 |
| 4,260,293 | 4/1981 | Peterson | 52/263 X |
| 4,697,393 | 10/1987 | Madray | 52/737.2 X |
| 4,894,898 | 1/1990 | Walker . | |
| 4,959,934 | 10/1990 | Yamada et al. | 52/167.7 |
| 5,148,642 | 9/1992 | Plumier et al. | 52/167 |
| 5,163,256 | 11/1992 | Fukumoto . | |
| 5,349,794 | 9/1994 | Taga . | |
| 5,491,938 | 2/1996 | Niwa et al. | 52/167.1 |
| 5,527,625 | 6/1996 | Bodnar | 52/634 X |
| 5,590,506 | 1/1997 | Cunningham | 52/741.3 |
| 5,595,040 | 1/1997 | Chen . | |
| 5,680,738 | 10/1997 | Allen et al. | 52/736.2 X |

OTHER PUBLICATIONS

Chen, Sheng–Jin and Chen, Gwang–Kai, "Fracture of Steel Beam To Box Column Connections," Journal of the Chinese Institute of Engineers, vol. 16, No. 3, pp. 381–394 1993.

Popov, Egor P., Amin, Navin R., Louie, Jason J.C., and Stephen, Roy M., "Cyclic Behavior of Large Beam–Column Assemblies," Earthquake Spectra, Earthquake Engineering Research Institute, vol. 1, No. 2, pp. 9–23, 1985.

Engelhardt, M.D., and Husain, A.S., "Cyclic Loading Performance of Welded Flange–Bolted Web Connections," Journal of Structural Engineering, American Society of Civil Engineers, vol. 119, No. 12, pp. 3537–3550, Dec. 1993.

Blodgett, Omer, "Details to Increase Ductility in SMRF Connections," The Welding Innovation Quarterly, vol. XII, No. 2, 1995.

Chen, Sheng–Jin and Yeh, C.H., "Enhancement of Ductility of Steel Beam–to–Column Connections for Seismic Resistance," Proceedings: Reports on Current Research Activities, Structural Stability Research Council, 1994.

Englehardt, Michael, Winneberger, Ted, Zekany, Andrew, and Potyraj, Timothy, "The Dogbone Connection: Part II," Modern Steel Construction, American Institute of Steel Construction, Aug., 1996.

Fairweather, Virginia, "Seismic Solutions for Steel Frame Buildings," Civil Engineering, American Society of Civil Engineers, Mar., 1996.

FEMA–267, *Interim Guidelines: Evaluation, Repair, Modification and Design of Welded Steel Moment Frame Structures*, Federal Emergency Management Agency, Aug., 1995.

FEMA–267A, *Interim Guidelines Advisory No. 1: Supplement to FEMA 267*, Federal Emergency Management Agency, Mar. 1997.

Hall, W.J., and Newmark, N.M., "Shear Deflection of Wide Flange Steel Beams in the Plastic Range," Proceedings of Engineering Mechanics Division, American Society of Civil Engineers, Oct., 1955.

Iwankiw, Nestor, and Carter, Charles, "The Dogbone: A New Idea to Chew On," Modern Steel Construction, American Institute of Steel Construction, Apr., 1996.

Kehoe, Brian, Freeman, Sigmund, Sasaki, Ken, Paret, Terrence, "Earthquake Damage to Welded Steel Moment Connections," Letters to the Editor, Structural Engineers Association of Northern California News, San Francisco, Sep., 1996.

Miller, Duane K, "The Northridge Earthquake: An Update," The Welding Innovation Quarterly, vol. XII, No. 2, 1995.

Nakashima, Masayoshi, "Strain–Hardening Behavior of Shear Panels Made of Low–Yield Steel–I: Test," Journal of Structural Engineering, American Society of Civil Engineers, Dec., 1995.

Plumier, Andre, "New Idea for Safe Structures in Seismic Zones," Proceedings of the IABSE Symposium, University of Liege, Brussels, 1990.

Tsai, K.C., and Popov, Egor P., "Seismic Steel Beam–Column Moment Connections," in *Background Reports: Metallurgy, Fracture Mechanics, Welding, Moment Connections and Frame Systems Behavior*, FEMA–288, Federal Emergency Management Agency, Mar. 1997.

MOMENT-RESISTANT STRUCTURE, SUSTAINER AND METHOD OF RESISTING EPISODIC LOADS

This application claims the benefit under 35 U.S.C. Section 119(e) of U.S. Provisional Application No. 60/023,325 filed Sep. 11, 1996.

BACKGROUND OF THE INVENTION

1. Field of the Invention

The present invention relates to a moment-resistant structure, sustainer, and method of construction for deformably resisting episodic loads, particularly those of high intensity. The episodic loads may be due to earthquake, impact, or other intense episodic sources. The structure and sustainer may be in buildings, bridges, or other civil works, land vehicles, watercraft, aircraft, spacecraft, machinery, or other structural systems or apparati. The sustainer is a rigid member which resists transverse loading and supports or retains other components of a construction, such as a joist, a beam, a girder, a column, or any member which resists transverse loading. The structure or sustainer may be comprised of metals, such as steel, iron, aluminum, copper, or bronze, or of wood or wood products, or of concrete, plastics, other polymers, fiberglass or carbon fiber composites, ceramics, or other materials or combinations involving these and other materials.

2. Description of Prior Art

Steel structures generally had been regarded by structural engineers and architects as providing excellent resistance to earthquake motions, in large part owing to the substantial deformation capacity of steel members observed in laboratory and field studies. However, the 1994 Northridge earthquake caused unexpected, severe, and widespread damage to steel moment-resistant frame structures in the Los Angeles area. Much of the damage to steel moment-resistant frames occurred at or near the welded connections between steel girders and columns. In some buildings over 80 percent of the connections were found to have had brittle fractures at the connection welds or in girder or column material adjacent to the welds. Concern was such that numerous experimental and analytical research studies were initiated to determine the cause of the fractures and to determine applicable solutions for the design of new steel structures and for the rehabilitation of existing steel structures.

The Japanese also had believed steel structures had superior resistance to earthquakes, but brittle failures at or near connections like those observed in Los Angeles were found after the 1995 earthquake that shook Kobe. Fractured beam-column connections were also observed in recent inspections of steel buildings in the San Francisco Bay Area, possibly resulting from the 1989 Loma Prieta earthquake.

The causes of these fractures are attributed to the following possible sources: the welding procedure and conditions, the use of backup bars and run-off tabs, the characteristics of the girder and column material, and configurations that cause triaxial restraint to develop in the vicinity of the welds. The fractures occurred more often at or near the bottom flange weld, and this is believed to result from difficulties in achieving acceptable welds because physical access to the bottom flange is impeded, and because the floor above the beam protects the top flange and forces the bottom flange to experience larger strength and deformation demands. With regard to material characteristics, attention focuses on the fracture toughness of the materials, weld material deposition rates, and through-the-thickness variations in material properties of the column flanges. In addition to these potential causes, stress and strain concentrations naturally arise at junctures, such as at a girder-column connection. Due to the above variables, it can be seen that the strength of a girder-column connection cannot be predicted with certainty and can only be estimated.

Research into the causes of the fractures and possible solutions is ongoing. Laboratory tests of full-size specimens have fractured at small deformations, reproducing the behavior apparent in the field. Techniques for the repair of fractured connections, for the rehabilitation of existing, undamaged connections, and for the design of new structures have been tested. Even the best of these have limited deformability, are costly, and may be unreliable.

The approaches and solutions investigated to date concern (1) achieving improved material deformability characteristics through controls on welding materials and procedures, (2) relieving conditions of triaxial restraint by "softening" the region near the welds by removing some girder and/or column material, thus lessening the degree of restraint, (3) providing new details for ductile connections, designed with the intention that inelastic deformations should take place within the connection rather than in the girder, (4) weakening the girder flanges in specific locations so that inelastic flexural deformation of the girder takes place in zones located at some distance from the girder-column connection, (5) strengthening the connection to shift inelastic flexural demands to the girder, away from the column face, and (6) combinations of the preceding. For some of these approaches ((3), (4), and (5)), the connection is protected from inelasticity by providing weaker elements that will deform or plastify at lower loads.

A basic tenet in earthquake-resistant structural design is that savings in structural weight and cost can be obtained if the structure is designed and detailed to respond in a ductile, inelastic fashion. A second basic tenet in earthquake-resistant structural design is that ductile, inelastic response should preferably take place in plastic hinge zones located in the beams and girders of a frame rather than in the columns. The reason for this second tenet is concern that the integrity of a column may be compromised if it developed a plastic hinge, and this could jeopardize the stability of the numerous floors that may be supported above. Existing design practice provided for the formation of plastic hinge zones in the beams and girders, adjacent to the columns, and consistent with these tenets.

Steel moment frames were used frequently in earthquake-prone areas, due to market forces and the mistaken belief that this structural system had ample deformation capacity. Perhaps because of this belief some inherent disadvantages of the system were overlooked or tolerated. Note that:

- Frames subjected to seismic loading experience the largest stress and strain demands in their most vulnerable locations—at the beam-column connection where the connection welds and heat-affected zones are located.
- The steel provided to the construction may have varied strengths relative to the strengths assumed in the design. Where the strength of the girders is relatively high, an increased likelihood results that plastic hinges develop in the columns.
- The presence of a floor slab supported by an underlying girder can increase the flexural strength of the composite slab-girder. This unanticipated strength may have the undesirable effect of forcing plastic hinges to develop in the columns.
- The concentration of inelasticity into relatively small locations (plastic hinges) requires the material to undergo very large strain demands locally. Distributing the inelastic demands over larger volumes of material would reduce the local demands, and enhance the displacement capacity of the structure.

The conventional practice of using unperforated beams and girders requires that additional space be provided for service utilities between the ceiling and the structural framing.

The conventional practice makes no provision for the post-earthquake restoration of the structure. Repairs may be so costly as to warrant replacement of the building, or cumbersome rehabilitation.

Attempts to remedy the fracture problem have consistently embraced the flexural yielding paradigm despite the disadvantages noted above.

Improving the quality of the welds and base materials, or increasing the connection strength adequately to promote the development of plastic hinges in the beam away from the connection is expensive.

Details required to relieve triaxial restraint are also costly. Experimental evidence indicates that these techniques provide only moderate levels of ductility capacity; peak stresses continue to occur at the beam-column connection, and weld quality remains extremely important to the ductility capacity of the connection.

Other connection details have been proposed to protect the connection from overstress by promoting yielding in the body of the connection rather than in the girders or columns. These connections are costly to implement in the field, and affect the stiffness of the building, which in turn affects the required lateral design strength and its displacement response and deformability demand. Often it is not possible to configure these connections to support beams and girders framing into various sides of a column simultaneously.

The girder may be intentionally weakened by reducing the flange cross section to promote plastic hinging at a location offset from the connection to the column, representing a worthwhile attempt to draw inelastic action away from the welded beam-column connection where brittle failures might initiate. But this approach has its disadvantages: (1) it is relatively costly to cut the flange at four locations at each end of the beam; (2) it is not practical to cut the top flanges where floor slabs may be present in the rehabilitation of existing construction; (3) because the plastic hinge zones are set in from the columns, they are subjected to larger deformations to achieve the same displacement of the structure; (4) heavier, more costly beams must be used in order that the cross section having reduced moment capacity provide the system with adequate strength; (5) the removal of flange material reduces the stability of the beam, thereby limiting its deformation capacity; and (6) the asymmetrical removal of flange material, as may happen recognizing the inexactness with which the flange cuts may be executed, may induce instabilities, further limiting the deformation capacity.

While the foregoing approaches concern recent suggestions to improve steel moment resistant frames, other approaches to earthquake resistant design merit some discussion and bear on the invention.

The eccentric-braced steel frame was developed by Popov in the 1970s and 1980s. In this system, diagonal braces are offset from the beam-column connections in order to develop an eccentricity between the brace and the beam-column working point. This induces high shears on a short segment of the beam, causing it to yield principally in shear under strong lateral motion. The shear yielding of this link beam is the only intended zone and mode of inelastic response. The large shear strains that the link beam is capable of sustaining provides the inelastic deformability of the system. The eccentric-braced frame has been used in a number of structures, some which were shaken by the Northridge earthquake and reportedly performed quite well. Widespread adoption of the system has been limited by its higher cost and the presence of the diagonal brace, which interferes with floor space utilization. The cost of this system is bound to increase as it becomes necessary to provide more control over the quality of the welds. As for flexural yielding systems, the eccentric braced frame imposes relatively high local strain demands because the zones of inelasticity are relatively few in number and small in size.

Alternative approaches to earthquake resistant construction are also being developed. Of particular interest are the use of supplemental damping devices. One such device, the ADAS element, is configured with an hourglass shape so that yielding in flexure develops inelastic response throughout the volume of the material rather than in discrete zones near the member ends. Another device causes steel plates to yield in shear. Nakashima reports very desirable properties for a steel used in this manner for purposes of controlling response to earthquakes, including stable, ductile hysteretic response to large strains over a large number of loading cycles. This device would be positioned between an oscillating structure and a rigid frame. Another approach incorporates a lead plug in the center of a base-isolation bearing to provide additional stiffness and damping. These three methods all show good performance in the laboratory, but significant cost and architectural accommodations are required to providing the support systems required to use these devices. They also require specialized knowledge and analysis to implement. These aspects hinder their use in mainstream construction.

After a damaging earthquake it is usually necessary to evaluate the integrity of the structural system, to determine whether it is able to resist future earthquakes, or whether repairs or more extensive rehabilitation is needed. The judgement of the engineer is often relied upon, because existing standards are not broad enough in scope and because it is not possible to accurately determine the loss in capacity, if any. Options are limited, because conventional structural systems are not designed for the replacement of damaged elements. It is generally easier to replace supplemental damping devices in alternative structural systems, but other aspects hinder their broad acceptance.

SUMMARY OF THE INVENTION

An object of the present invention is to provide an economical and reliable structural system for deformably resisting episodic loads such as those due to earthquake, impact and other intense episodic sources which can be utilized in both new structures and in the rehabilitation of existing structures. The present invention utilizes the substantially uniform distribution of shear along the length of a sustainer to determine dissipative zones in cooperation with voids to create deformable resistance.

Additional objects and advantages of the present invention are described as follows:

(a) the provision of dissipative zones capable of absorbing or dissipating substantial amounts of distortional vibration energy;

(b) the provision of dissipative zones capable of sustaining large deformation demands distributed over the length of the girder web;

(c) the provision of dissipative zones that are subjected to predominantly biaxial or plane stress conditions, thus preventing conditions of triaxial restraint such as occur at conventional beam-column connections that limit the ductility and strain capacity of the material;

(d) the advantageous use of strain hardening properties of the material to cause the spread of inelasticity to multiple dissipative zones, thus offsetting the tendency for strain concentrations to develop because of deviations from ideal conditions owing to material, workmanship, and loading variations, thereby achieving a robust system for providing deformation capacity;

(e) the efficient use of structural material, because deformation demands are distributed to numerous dissipative zones located over the member length, avoiding the concentration of deformation demands in localized areas and the potential for material exhaustion in these areas;

(f) the provision of a structural fuse, that by yielding of the web, regulates the forces and bending moments resisted at the beam-column connection, thereby protecting the beam-column connection from stress and strain demands that, if excessive, i.e., if exceeding the beam-column connection's strength capacity, would likely cause brittle fracture of the welds or adjacent beam or column material;

(g) the requirement that welds only be of sufficient quality to prevent fracture of the welds or adjacent beam and column material for the reduced forces and bending moments associated with the deforming dissipative zones, thereby avoiding the demands and expense of current practices;

(h) the achievement of a connection of sufficient strength to force inelastic demands to occur in the girder away from the connection by regulating the forces and bending moments resisted at the beam-column connection without the expense of current practices;

(i) the limitation of stress and strain demands, that if excessive, might cause brittle failure of the column flange because of the inferior material properties of relatively thick column flanges by regulating the forces and bending moments resisted at the beam-column connection;

(j) the reduced possibility that the strength of the girder might exceed the strength of the column, by regulating the forces and bending moments resisted at the beam-column connection, thereby helping to prevent plastic hinges from developing in the column;

(k) the reduced possibility that contributions of the floor slab to the flexural strength of the girder can force inelasticity to develop in the columns because the shear force that may be carried by the girder is regulated;

(l) the reduced possibility that variability in materials strengths leads to uncertainties in the mode or locations of inelastic response by utilizing girders composed of the same material throughout, thus causing the shear strength of the girder to vary in proportion to the flexural strength of the connection;

(m) the reduction in complications arising from the three-dimensional configuration and interaction of beams, girders, and columns by regulating the strength of the beams and girders;

(n) the achievement of flexibility in floor space usage by not requiring the use of diagonal members;

(o) the reduction in materials requirements and cost achieved by providing apertures in the webs of the beams through which mechanical equipment and utilities may pass, thereby allowing reduced story heights and allowing more floors to be built in regions with zoning restrictions on building height;

(p) the expeditious and economical restoration of the lateral force-resisting qualities of a structure by providing for the replacement of girders after a damaging earthquake;

(q) the economy with which the web openings can be fabricated relative to the expense required to cut the flanges or provide other means for improving the displacement capacity of the structural system;

(r) the economy with which the web openings can be introduced into existing structures compared with the effort and expense required to implement other retrofit techniques;

(s) the ease with which the structural system can be modeled for purposes of determining design forces and displacements relative to other structural systems;

(t) the ease with which the structural system can be designed relative to other systems because the one or more voids have slight or negligible effects on the stiffness of the structural system; and, (u) the latitude given to the structural engineer to reliably specify locations where inelastic response may develop and modes of inelastic response, thereby giving the engineer the ability to control the displacement capacity and response characteristics of the structure.

These objects are achieved according to the present invention by providing a structure that includes sustainers in which one or more voids define dissipative zones capable of deforming inelastically. The web of the sustainer has one or more voids of sufficient size, shape, and configuration to reduce the strength of the sustainer having one or more voids sufficiently so that those other members and connections of the structural system that are desired to remain elastic remain substantially elastic. The strength of the voided sustainer thus regulates the forces and stresses that may be imposed on other structural members and connections, and therefore acts as a structural fuse. Therefore, having a plurality of these sustainers having one or more voids prevents stresses elsewhere from reaching intensities that might otherwise cause brittle behavior, fracture, or other undesirable behaviors.

Accordingly, sustainers having one or more voids may be attached permanently, or may be attached to facilitate their replacement to allow the integrity of the structural system to be restored by replacing sustainers that undergo substantial inelastic distortion as a result of episodic loading.

BRIEF DESCRIPTION OF THE DRAWINGS

The invention will become more readily apparent from the following description, reference being made to the accompanying drawings showing several embodiments of the invention. In FIGS. 1 through 17, the sustainer is approximately horizontal and is represented by a girder. These figures are not intended to limit the scope of the invention, which includes any rigid sustainer that resists transverse loading such as a joist, a beam, a girder, or a column.

FIG. 1 is an elevation view of a prior art structural system of a building, showing girders and columns.

FIGS. 2 through 17 show side elevation views.

FIG. 2 shows a portion of a structural system wherein the girders contain voids having circular cross section.

FIG. 3 through FIG. 6 show some of the many possible configurations of voids that may be used. FIG. 3 shows voids having a hexagonal cross section. FIG. 4 shows voids having an ellipsoidal cross section. FIG. 5 shows voids having a triangular cross section. FIG. 6 shows a combination of voids having triangular and rhombic cross sections.

FIG. 8 shows a castellated girder having voids of circular cross section.

FIG. 9 shows a castellated girder having voids of hexagonal cross section.

FIG. 10 shows a girder wherein the size of the voids varies along the length of the girder.

FIG. 11 shows a girder wherein voids of various shapes are used.

FIG. 12 shows a portion of a structural system wherein the voids are located in the girder near the columns.

FIG. 13 shows a portion of a structural system wherein the girder depth varies over its length.

FIG. 14 shows a portion of a structural system wherein the central girder segment is secured to column trees which comprise columns rigidly connected to adjacent girder stubs. The connection of the central girder segment may be made to facilitate replacement of the girder segment.

FIG. 15 shows a portion of a structural system wherein the girder is removably secured to the columns.

FIG. 16 shows a portion of a structural system wherein a removable girder segment and connecting means are shown by phantom lines.

FIG. 17 shows a portion of a structural system wherein continuity plates, doubler plates, and stiffeners are present.

FIG. 18 shows a cross section of the sustainer of FIG. 17, illustrating the stiffening of the web.

FIG. 19 shows a cross section of a sustainer, in particular, an I-shape, reduced by the presence of a void.

FIG. 20 shows a cross section of a sustainer, in particular, a wide flange shape, reduced by the presence of a void.

FIG. 21 shows a cross section of a sustainer, in particular, a T-shape, reduced by the presence of a void.

FIG. 22 shows a cross section of a sustainer, in particular, a composite shape, comprising a T-shape and a floor slab, reduced by the presence of a void.

FIG. 23 shows a cross section of a sustainer, in particular, a composite shape, comprising a wide flange shape and plates attached to the flanges.

FIG. 24 shows a cross section of a sustainer, in particular, a box shape.

FIG. 25 shows a cross section of a sustainer, in particular, a wide-flange shape, reduced by the presence of a void, having the cross section of the void stiffened by a tubular segment.

DETAILED DESCRIPTION OF THE INVENTION

Figure 1:
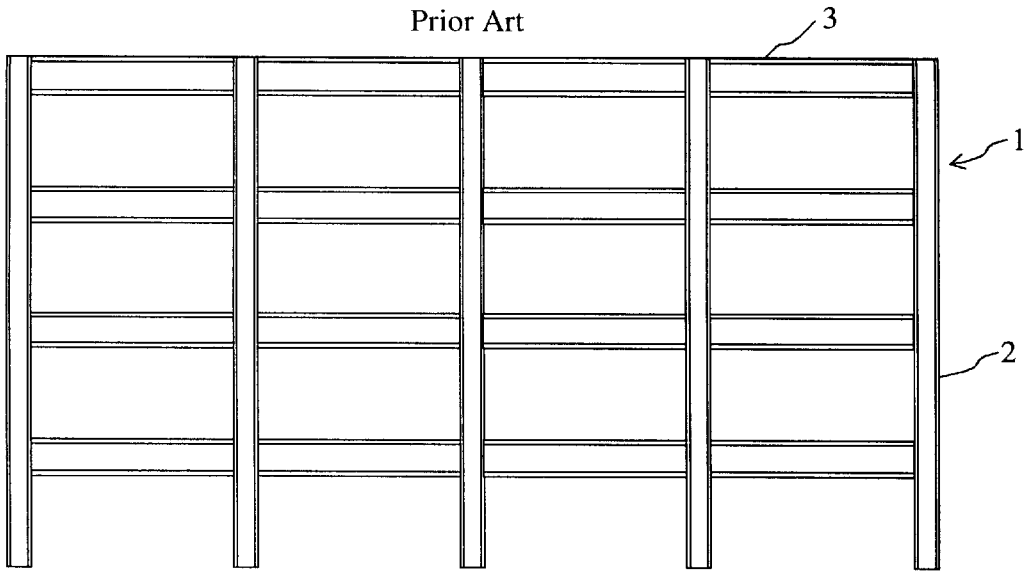

FIG. 1 shows an elevation of a conventional structural system 1 for a building. Identified in FIG. 1 is a column 2 and a sustainer such as girder 3. Present practice and codes of construction grant the designer the privilege to select some portion or all of the structural system 1 to be designed and detailed particularly to provide the structure with resistance to loads caused by earthquake, impact, or other intense episodic sources.

The sustainers in the following examples may be used in buildings, bridges, or other civil works, land vehicles, watercraft, aircraft, spacecraft, machinery, or other structural systems and apparati where deformable resistance to intense episodic loads is desired.

Preferred Embodiment

Figure 2:
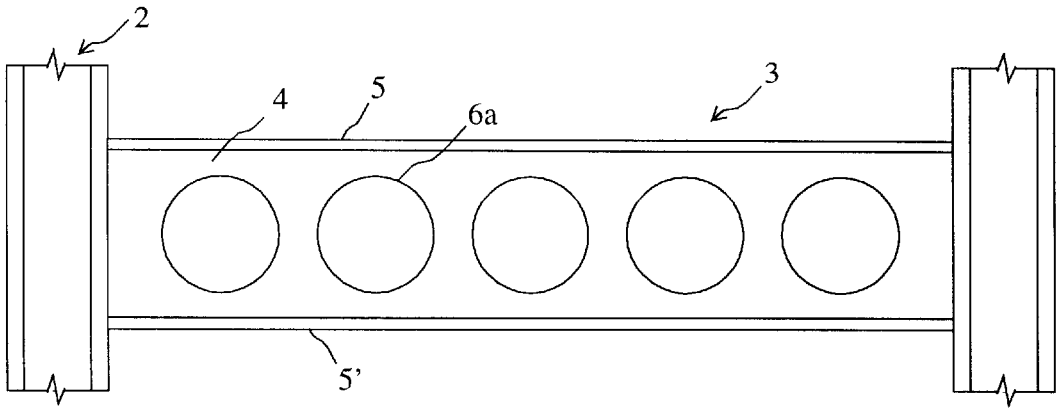

FIG. 2 shows a sustainer such as girder 3 connected rigidly to a column 2 at either end of the girder. The girder 3 consists of a web 4 and flange plates 5, 5'. The web 4 is penetrated by a number of voids, such as voids 6*a* having a circular cross section. A preferred embodiment utilizes a single row of uniform voids, each void having a substantially circular cross section with the voids being substantially centered between the flanges and distributed along the length of the girder.

Consider a steel wide flange beam secured rigidly at its ends to adjacent columns, subjected to loads and deformations imparted only by the columns, and having a point of inflection at midspan. The peak normal stress developed in the flanges at the connection to the columns is desired to be limited to a nominal target valued $f_S$, also known as the maximum allowable demand, which may be less than the yield strength of the steel material. Because beams of ordinary dimensions have sufficient shear strength to generate stresses well in excess of $f_S$, openings will be provided in the beam web to cause it to yield, thereby preventing the stress in the flanges from exceeding the nominal target value $f_S$. The nominal target value $f_S$ is, of course, less than the estimated strength of the connections. If the nominal target value were greater than the estimated strength, damage to the connections could occur before deformation of the beam webs if subjected to a large episolic load.

The size and spacing of an integral number of uniform voids having a circular cross section and arranged in a single row that is centered between the flanges may be determined using two criteria as follows:

The first criterion considers the shear strength of the beam section transverse to the beam at a location of the void. The second criterion considers the shear strength of the web at the location of the void in the longitudinal direction of the beam. It is considered that the deformations characteristic of yielding according to these criteria differ, and that the propensity to deform according to one criterion or the other can be varied by adjusting the relative strengths of the cross sections containing voids through the selection of the size, shape, and configuration of the voids.

According to accepted practice, the shear strength of the unreduced beam can be approximated by $f_y t_w d$, where $f_y$ is the yield stress of the steel material in shear, $t_w$ is the thickness of the web, and d is the depth of the beam. Similarly, the moment, M, corresponding to the development of the stress $f_S$ is given by $f_S S$, where S is the section modulus of the beam. For the beam to develop these moments in contraflexure at the column faces requires that the beam carry a shear, V, equal to 2M/L, where L is the clear distance between the closest faces of the opposed columns. The shear strength of the beam transverse to the beam at a location of the void (the first criterion) can be approximated by $f_y t_w (d-d')$, if the diameter of each void is d'. Thus, the void diameter d' should be set to $d-V/(f_y t_w)$ in order to cause the beam to yield at a load that nominally corresponds to the development of a target stress $f_S$. Substituting for V, the void diameter d' may be established as $d-(2f_SS)/(f_vt_wL)$.

According to accepted practice, the tension and compression forces that provide the flexural resistance, M, and which are equilibrated by the web of the beam, are approximately equal to M/d, or $f_SS/d$. For the contraflexure condition, the web must transmit $2f_SS/d$. The strength of the web at a location of the void, if the voids have diameter d', is given approximately by $f_vt_w(L-nd')$, where n is the number of circular voids. Thus, the second criterion implies that the aggregate width of the openings, nd', should be $L-(2f_SS)/(f_vt_wd)$. For voids having a diameter d', the above expressions require the integral number of voids to closely approximate L/d.

These one or more voids are then introduced into the web of the sustainer. The method of introduction of the voids may be by cutting, drilling, sawing, gouging, or by casting or rolling, or other methods, or by methods used to fabricate castellated beams. The periphery of the one or more voids may be altered or smoothened by grinding, by deposition of weld material, or by reinforcing with additional materials, possibly including welds. Other variations of fabricating the sustainers having one or more voids also exist and will be apparent to those skilled in the art.

Method of Construction

A method of construction of this invention is to secure sustainers having one or more voids in the web to adjacent sustainers that may or may not have voids, in order to achieve a structure that provides deformable resistance to loads caused by earthquake, impact, or other intense episodic sources. The sustainers may be connected at the site in their approximate ultimate desired configuration as the structure is erected. Alternately, portions of the structure or its entirety may be connected prior to erection, with any remaining connections being made in the approximate ultimate desired configuration at the site.

A second method of construction of this invention is to introduce one or more voids into the sustainers of an existing structure such as a building, thereby achieving a structure that is capable of providing deformable resistance to loads caused by earthquake, impact or other intense episodic sources. The one or more voids determine the locations of dissipative zones capable of deforming inelastically.

An alternate method of construction is to replace sustainers which have undergone inelastic deformation in existing structures with sustainers having one or more voids.

Variations in these methods of construction of this invention and within its spirit and scope and adaptations in specific circumstances will be obvious to those skilled in the art.

Alternate Embodiments

The one or more voids in the web of the sustainer may have any size, shape, and configuration that achieves the objects of the invention; the specific examples provided are intended to demonstrate the invention more fully without acting as a limitation on its scope, since numerous modifications and variations within the spirit and scope of the invention will be apparent to those skilled in the art.

Figure 3:
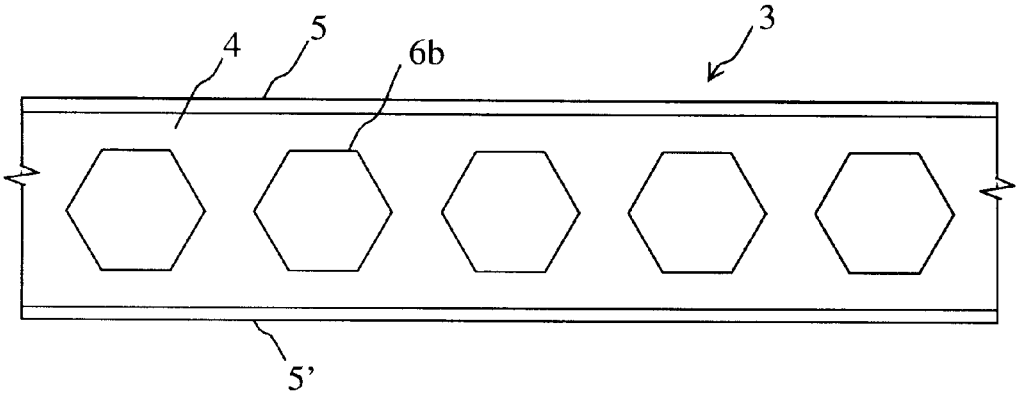
Figure 4:
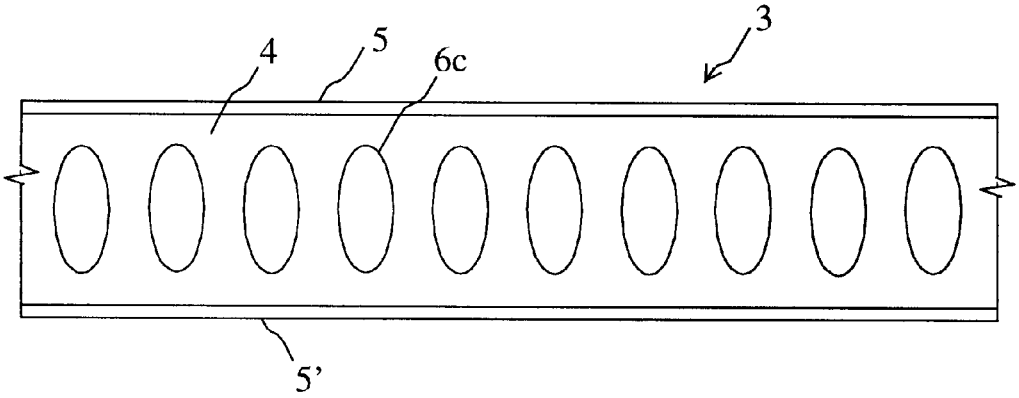
Figure 5:
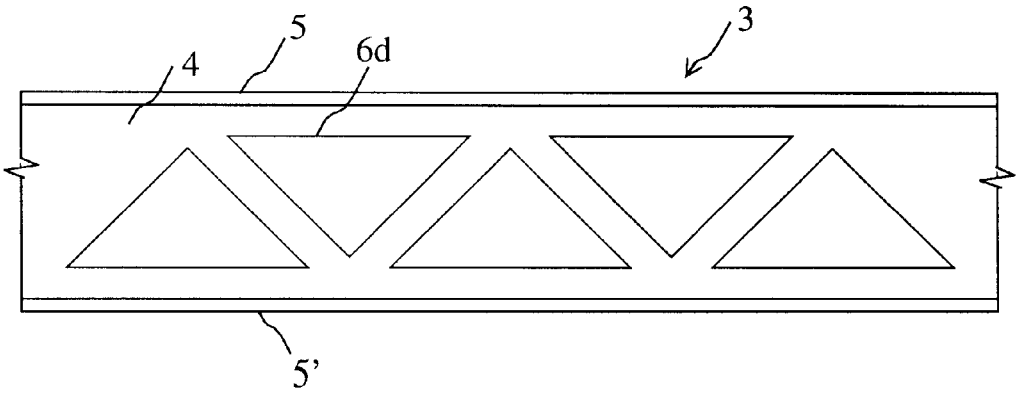
Figure 6:
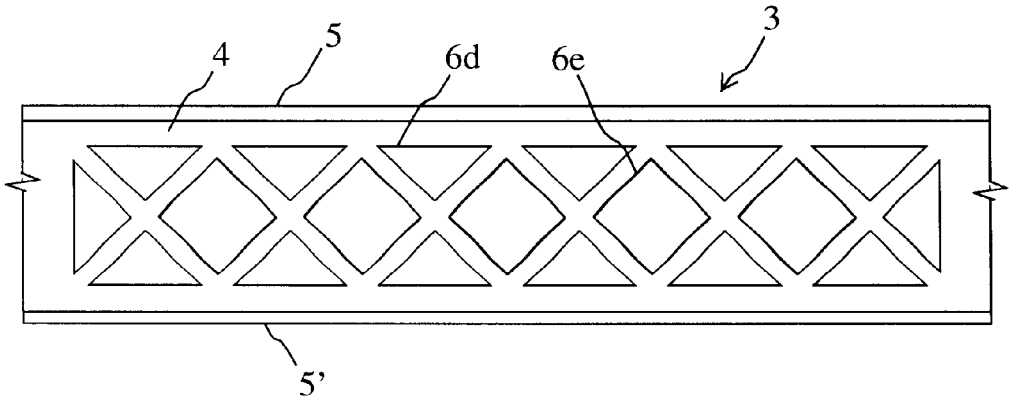

For example, the one or more voids may have a polygonal cross section such as voids 6*b* which have a hexagonal cross section, as shown in FIG. 3. The one or more voids may have a curvilinear cross section, such as voids 6*c* which are ellipsoidal, as shown in FIG. 4. The one or more voids may have a triangular cross section, such as voids 6*d* shown in FIG. 5. A single sustainer may combine voids of various shapes such as shown in FIG. 6, where voids 6*d* have a triangular cross section and voids 6*e* have a rhombic cross section.

Figure 7A:
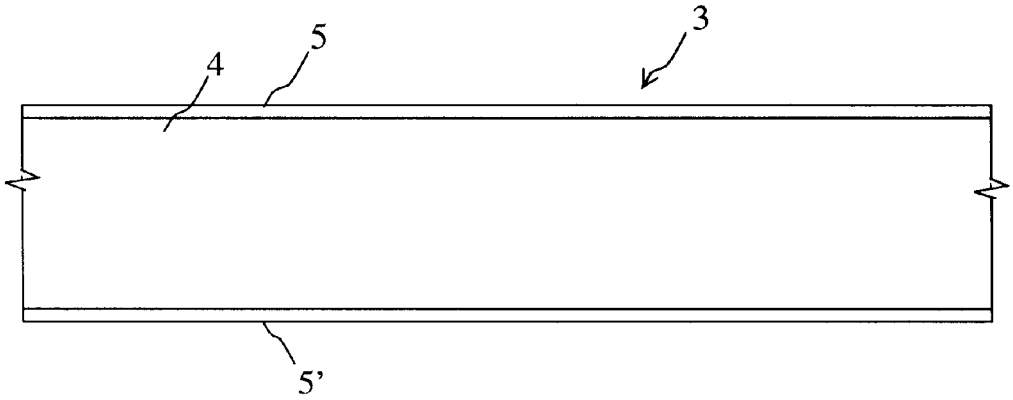
FIG. 7*a* shows a girder prior to removal of material to form voids.
Figure 7B:
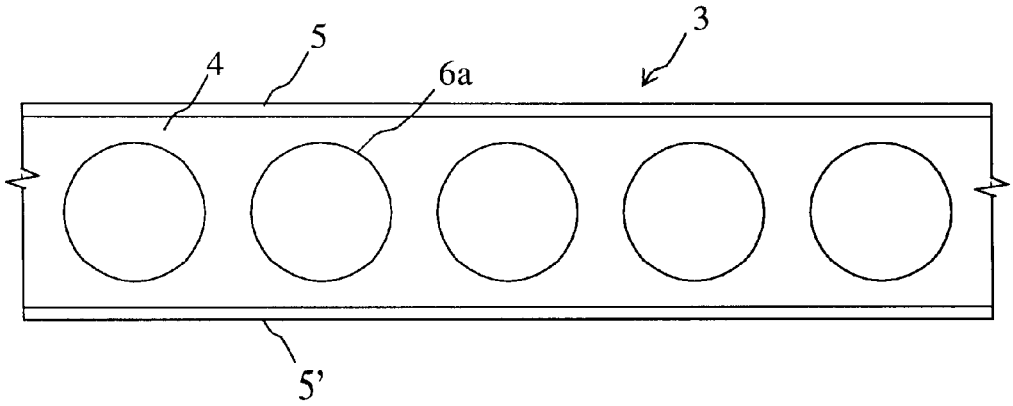
FIG. 7*b* shows a girder after removal of material to form voids of circular cross section.
Figure 8:
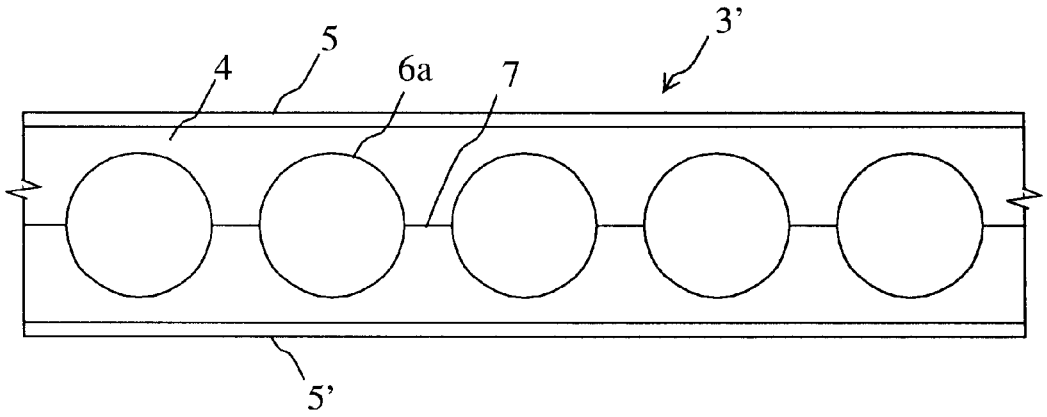
Figure 9:
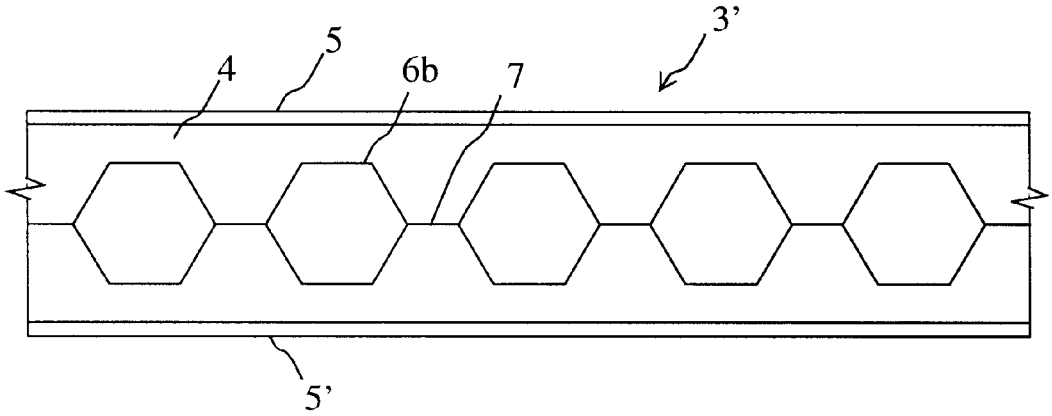

The voids may be introduced into existing moment-resistant frame structures to improve their resistance to episodic loads. The voids may also be introduced into sustainers during their fabrication for use in new construction, or may be introduced in the fabrication of castellated beams, or in the fabrication of plate girders. FIG. 7*a* and FIG. 7*b*, respectively, show a sustainer such as girder 3 before and after introduction of the voids. The voids may be introduced into the web 4 by any of the previously described methods used to introduce voids such as voids 6*a*. Variations in the means of introduction and applications also exist within the spirit and scope of the invention and will be apparent to those skilled in the art. FIG. 8 shows a castellated girder 3' penetrated by a multiplicity of circular voids 6*a*. FIG. 9 shows a castellated girder 3' penetrated by a multiplicity of polygonal voids such as hexagonal voids 6*b*. In FIG. 8 and FIG. 9, web 4 was composed of separate sections and these sections were joined together by weld 7 extending between and beyond the voids.

Figure 10:
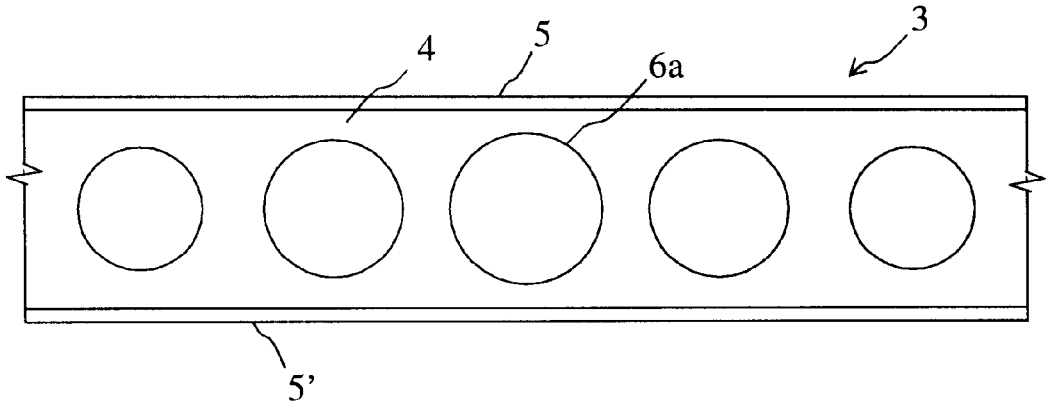

The voids may vary in size over their distribution along the sustainer. For example, FIG. 10 shows circular voids 6*a* having different diameters along the length of girder 3. One motivation for varying the size of the openings is to optimally distribute distortions over the length of the girder, accounting for shear-moment interaction.

Figure 11:
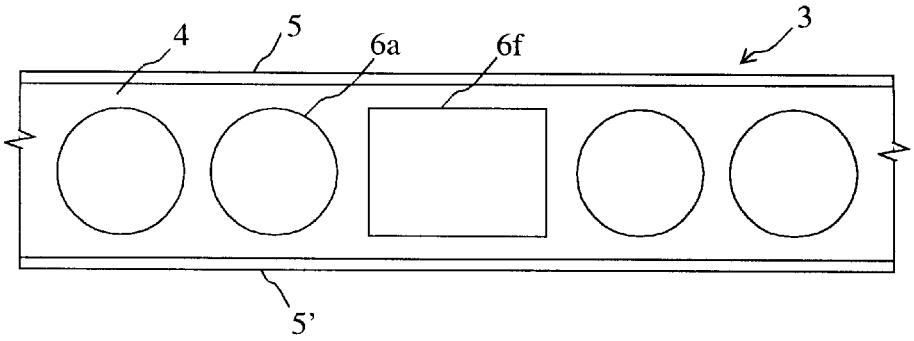

In addition, the shape of the voids may differ over the length of the sustainer. For example, FIG. 11 shows a girder 3 having substantially circular voids 6*a* and a substantially rectangular void 6*f*. One motivation for varying the shape of the openings is to accommodate the passage through of service utilities.

Figure 12:
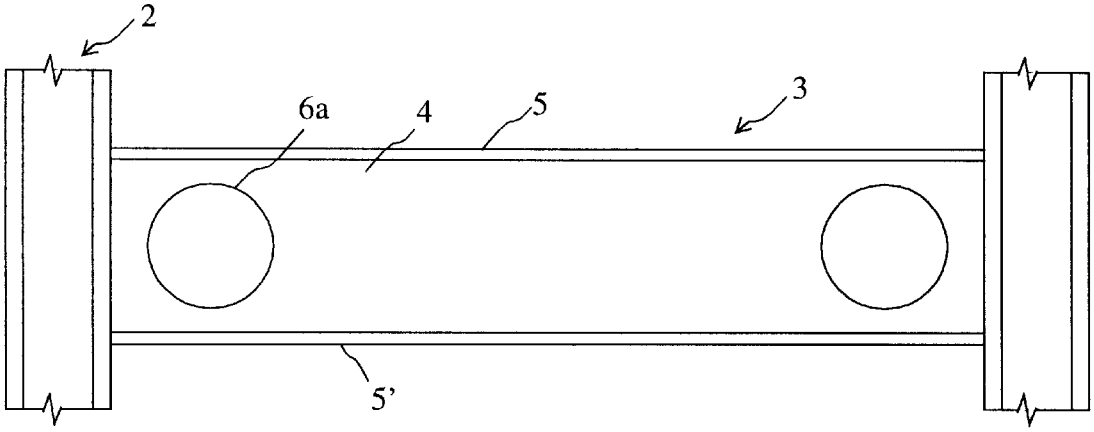

The voids may be nonuniformly distributed over the length of the sustainer. For example, FIG. 12 shows a girder 3 having a substantially circular void 6*a* at each end adjacent to the connection to column 2.

Figure 13:
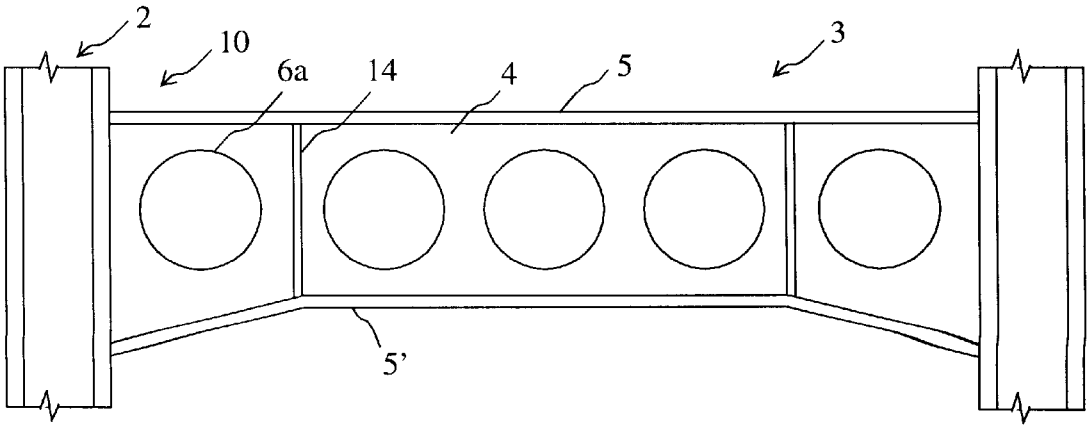

In the previous figures, the cross section of the sustainers was invariant over the length of the sustainer, except where the presence of a void reduced the cross section. The dimensions of the unreduced cross section may vary over the length of the sustainer. One example of cross section variation is illustrated in FIG. 13, which shows the presence of a haunch 10 at each end of girder 3.

Figure 14:
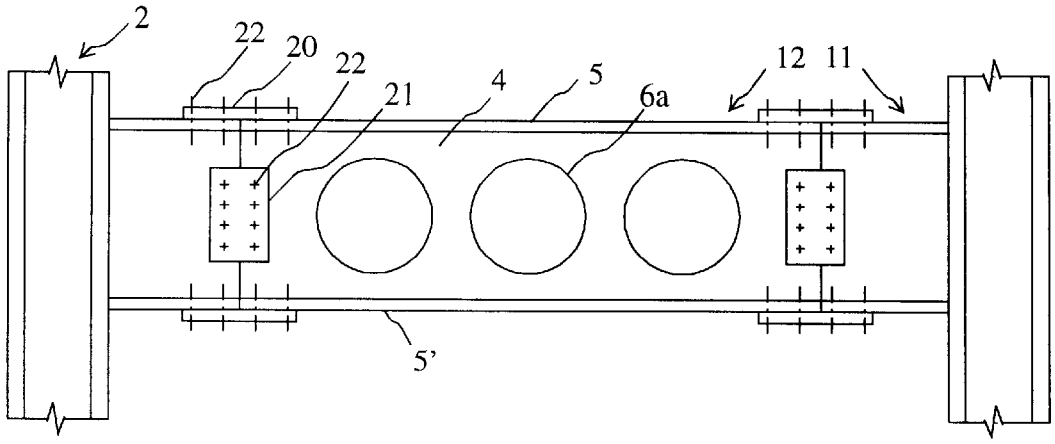

In the erection of the structure, it may be desirable to preform portions of the structure, erect these portions, and then attach sustainers to the erected portions. One conventional practice is to preform column trees which comprise columns and a short length of sustainer. The dimensions of the unreduced cross section of the short sustainer length may be invariant or may change along its length. For example, FIG. 14 shows preformed portions consisting of a column 2 and a girder stub 11 which is prismatic. Girder segment 12 is attached by a connecting means, such as the flange splice plate 20, web splice plate 21, and bolts 22, at the end of the girder stub 11 to the preformed portions. The connecting means need not comprise separate splice plates; for example, the ends of girder stub 11 and girder segment 12 alternatively may be prepared to permit their direct attachment to one another by bolting, welding, or other means.

Figure 15:
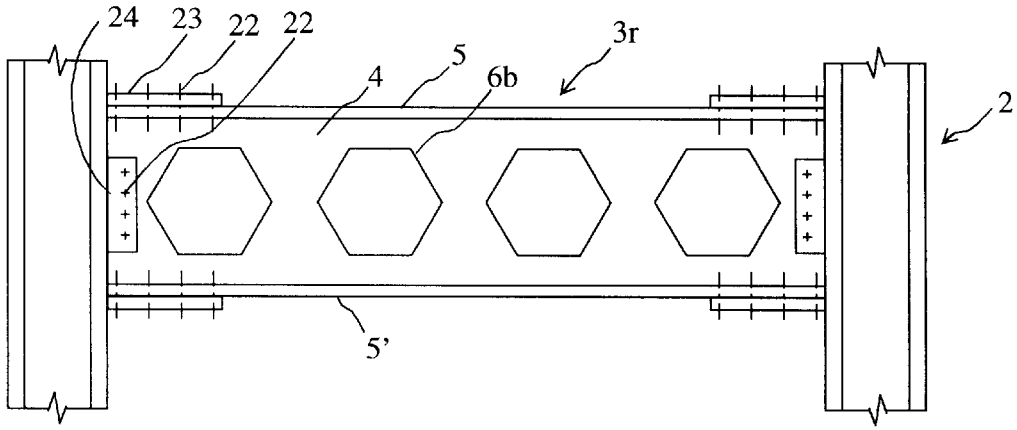
Figure 16:
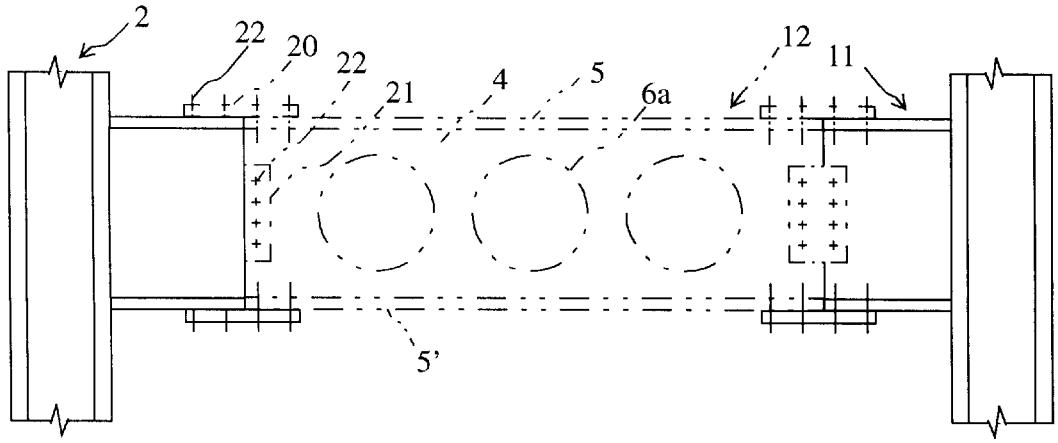

The sustainers may be attached in a manner that facilitates their removal and replacement in order that the integrity of the structure's resistance may be restored, should the sustainers be distorted by an episodic load. This may be achieved by providing a connecting means for attachment of the sustainers to the remainder of the structure that facilitates removal and replacement of the sustainer, such as the connection shown in FIG. 15. The connecting means of FIG. 15 consists of girder flange to column flange connector plate 23, shear tab 24, which secures replaceable girder 3*r* to column 2. Girder segment 12 in FIG. 14 may also be removably connected to the remainder of the structural system 1. FIG. 16 shows girder segment 12 being removably connected to adjacent structural elements such as girder stub 11. Girder stub 11 need not be attached to columns 2 prior to erection of the frame. The provision of various fittings and mounting hardware may further facilitate the removal and replacement of distorted sustainers.

Figure 17:
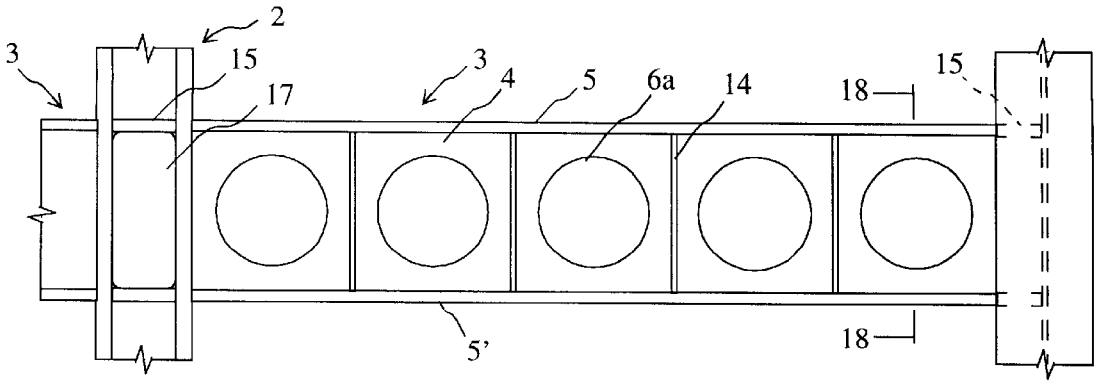
Figure 18:
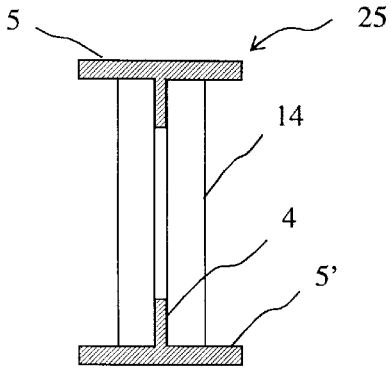
FIGS. 18 through 25 are cross sectional views that look down the longitudinal axis of a sustainer.

FIG. 17 illustrates conventional connecting means and other details that may be used in cooperation with the invention. Continuity plates 15 may be used to support the flanges of column 2 between the flanges of adjacent sustainers such as girders 3. Conventional details may also involve doubler plates 17 welded to the panel zone of the column. The stability and deformability of the voided sustainers such as girder 3 may be improved by the provision of stiffening means such as stiffeners 14 which may brace the web 4 and flange plates 5, 5'. Continuity plates 15 may be required in the provision of a secure connection of girder 3 framing into the side of column 2. The section indicated by cut 18 in FIG. 17 is illustrated in FIG. 18. FIG. 18 shows an example of a stiffening means, particularly stiffeners 14, together with an example of a sustainer cross section at the location of one of the one or more voids. In this example a wide flange shape 25 is shown.

Figure 19:
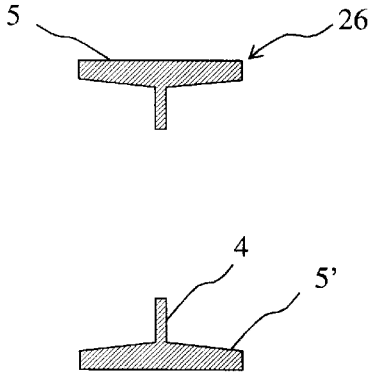
Figure 20:
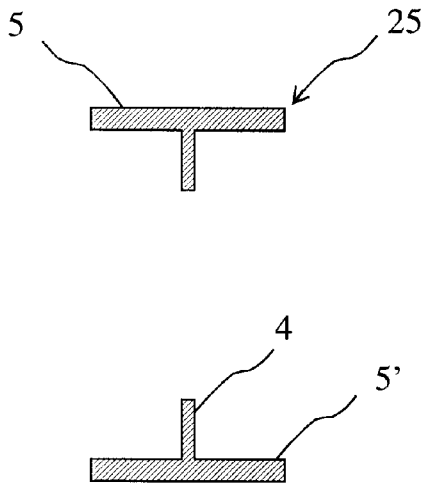
Figure 21:
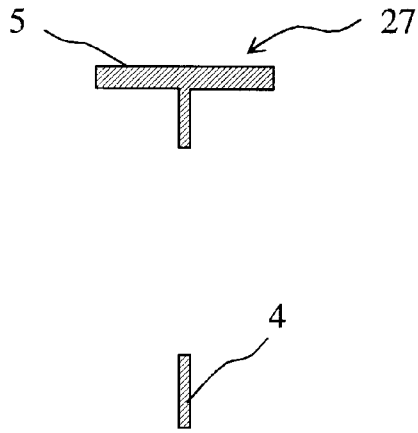
Figure 22:
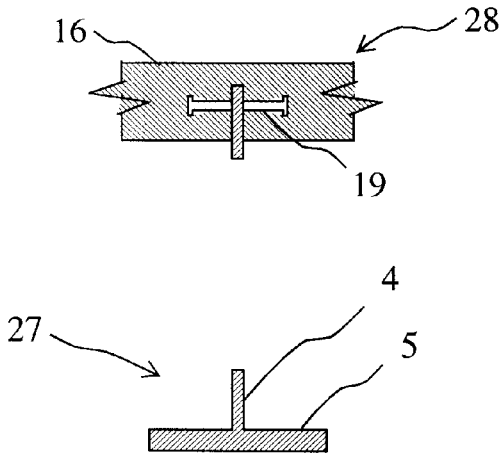
Figure 23:
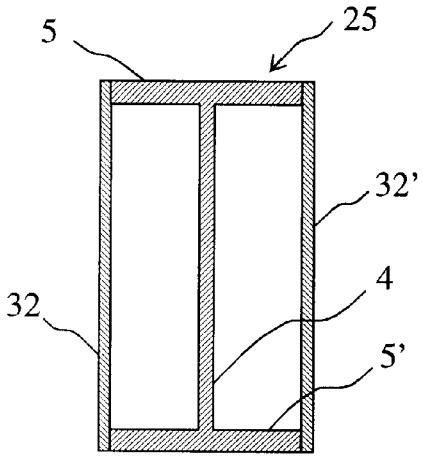
Figure 24:
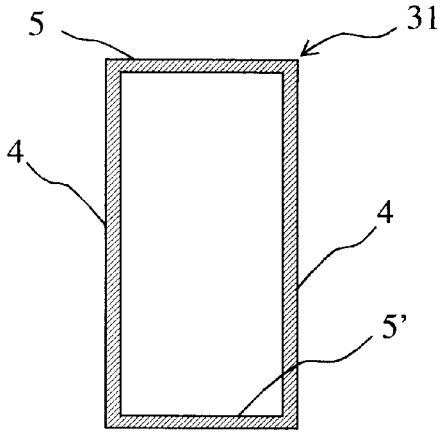

The invention may be utilized with a wide variety of sustainer cross sections when viewed down the longitudinal axis of the sustainer, of which several example cross sections are illustrated in FIG. 19 through FIG. 25. For example, FIG. 19 illustrates a cross section of a I-beam shape 26 at the location of the void. FIG. 20 illustrates a cross section of a wide flange shape 25 at the location of the void. FIG. 21 illustrates a cross section of a T-shape 27 at the location of the void. FIG. 22 illustrates a composite cross section 28 comprising a T-shape 27, a floor slab 18, and shear studs 19 placed to enhance the connection between the floor slab 18 and the T-shape 27. FIG. 23 shows a composite cross section comprising a wide flange shape 25 and plates 32, 32' secured to flanges 5, 5'. FIG. 24 shows a cross section of a box shape 31 which may or may not be composite. Other example cross sections include those of fabricated members and plate girders.

Figure 25:
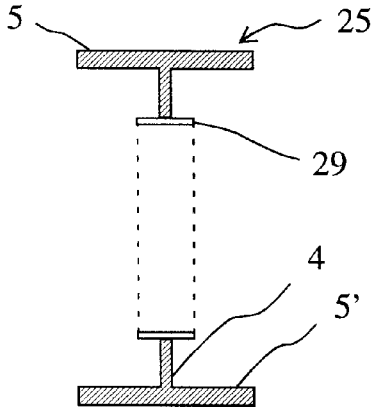

To increase the deformation capacity it may be desirable to smoothen the periphery of the void, such as by grinding, or to apply reinforcing means, such as the deposition of weld metal and possibly the attachment of additional material. An example of this is shown in FIG. 25, which illustrates the reinforcement of a circular void 6*a* by addition of a tubular segment 29 transverse to the sustainer and centrally located within the void.

Figure 26:
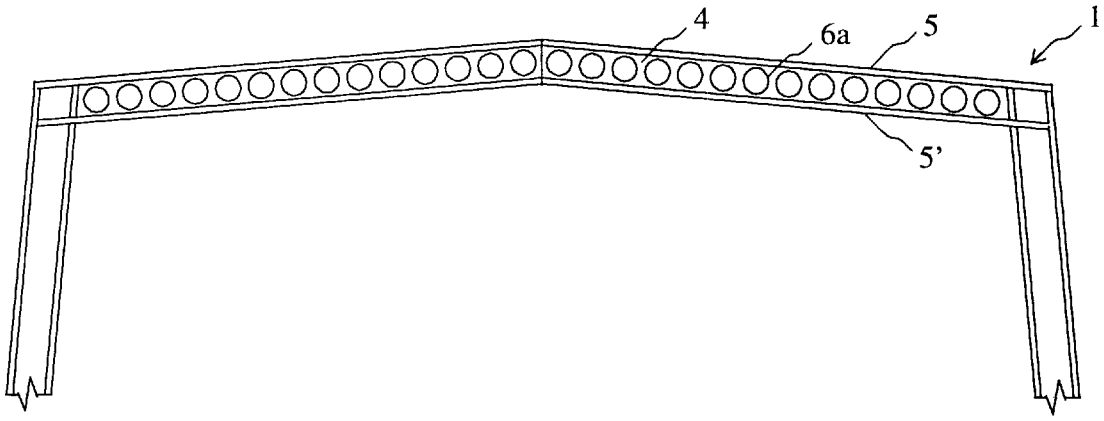
FIG. 26 shows a side elevation view of a structural system wherein the alignment of the members is not coincident with the vertical and horizontal directions.

The structure need not be restricted to horizontal and vertical sustainers, as there are often times buildings, bridges, or other civil works, land vehicles, watercraft, aircraft, spacecraft, machinery, or other structural systems or apparati that require a different alignment and possibly a different organization of the sustainers. FIG. 26 illustrates one such example, where the structural system 1 comprises sustainers not aligned vertically or horizontally, including some members having circular voids 6*a*.

Figure 27:
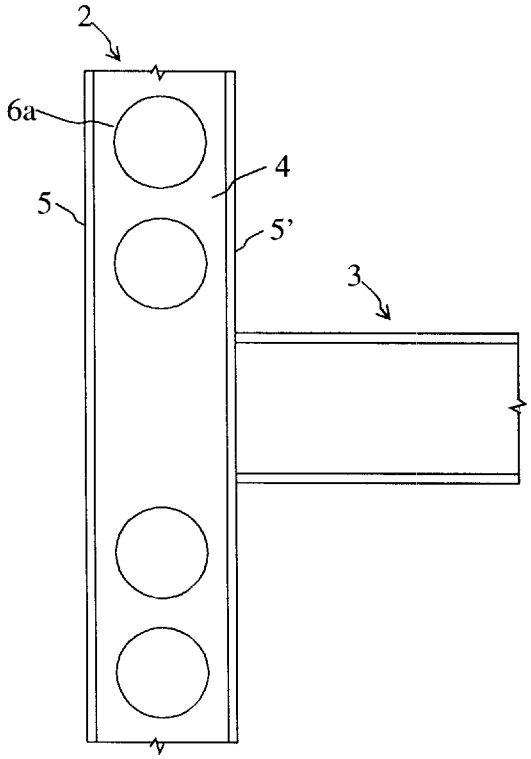
FIG. 27 shows a side elevation view of a structural system in which a column has voids.

In some circumstances, a single voided sustainer may compose the portion of the structural system 1 that deformably resists the episodic loads. In some applications the vertical members may be voided, as may be desirable for long-span low-rise construction, bridges, and other structures. FIG. 27 illustrates a structural system comprising a vertical sustainer and a horizontal sustainer, in which the vertical sustainer has circular voids 6*a*.

Although this invention has been described in preferred and alternate forms and methods and various examples with a certain degree of particularity, it is understood that in the present disclosure of preferred and alternate forms and methods, the various examples can be changed in the details and methods of construction and reasonably remain within the spirit and scope of the invention. Specific examples are intended to demonstrate this invention more fully without acting as a limitation upon its scope, since numerous modifications and variations will be apparent to those skilled in the art. The scope of the invention should be determined by the appended claims and not by the specific examples given.

I claim:

1. A method for making a structure having a frame resistant to severe damage from earthquakes and other episodic loads, the frame being formed of sustainers and members with moment-resistant connections there between, the method comprising:

(a) estimating a strength capacity of the moment-resistant connections;

(b) determining a maximum allowable demand to be allowed in the structure, which maximum allowable demand is less than the strength capacity of the moment-resistant connections; and (c) making one or more of the sustainers in the structure a web-deformable sustainer having two ends and a web, each sustainer having one or more voids in the web, the voids being of sufficient size, shape, and number such that the strength of the sustainer is less than the strength of a sustainer identical with the exception of having no such voids and such that the web deforms inelastically if and when the structure is subjected to an episodic load generating the maximum allowable demand;

such that, if and when the structure is subjected to an earthquake or other episodic load generating the maximum allowable demand, the deformation of the webs of the web-deformable sustainers prevents the demand at the moment-resistant connections from exceeding their strength capacity.

2. The method of claim 1 wherein the members are vertical columns.

3. The method of claim 2 wherein the web-deformable sustainers have a plurality of voids in the web.

4. The method of claim 3 wherein the web-deformable sustainers have a cross-sectional shape selected from the group consisting of wide flange sections, I sections, T sections, composite sections, plate girder sections, and fabricated sections.

5. The method of claim 4 wherein the web-deformable sustainers have a top flange and a bottom flange.

6. The method of claim 5 wherein the voids in the web-deformable sustainers have a cross-sectional shape selected from the group consisting of circular, hexagonal, oval, rectangular, curvilinear, and polygonal.

7. The method of claim 6 wherein the voids in the web-deformable sustainers are distributed evenly along the length of the sustainers.

8. The method of claim 6 wherein the voids in the web-deformable sustainers are located in close proximity to the ends of the sustainers.

9. A structure having a frame that is resistant to severe damage by earthquakes and other episodic loads, the frame being formed of sustainers and members with moment-resistant connections there between, the moment-resistant connections having a maximum allowable demand and a strength capacity, which maximum allowable demand is less than the strength capacity, the structure comprising:

one or more web-deformable sustainers having two ends and a web, each web-deformable sustainer having one or more voids in the web, the voids being of sufficient size, shape, and number such that the strength of the sustainer is less than the strength of a sustainer identical with the exception of having no such voids and such that the web deforms inelastically if and when the structure is subjected to an episodic load generating the maximum allowable demand;

such that, if and when the structure is subjected to an earthquake or other episodic load generating the maximum allowable demand, the deformation of the webs of the web-deformable sustainers prevents the demand at the moment-resistant connections from exceeding their strength capacity.

10. The structure of claim 9 wherein the members are vertical columns.

11. The structure of claim 10 wherein the web-deformable sustainers have a plurality of voids in the web.

12. The structure of claim 11 wherein the web-deformable sustainers have a cross-sectional shape selected from the group consisting of wide flange sections, I sections, T sections, composite sections, plate girder sections, and fabricated sections.

13. The structure of claim 12 wherein the web-deformable sustainers have a top flange and a bottom flange.

14. The structure of claim 13 wherein the voids in the web-deformable sustainers have a cross-sectional shape selected from the group consisting of circular, hexagonal, oval, rectangular, curvilinear, and polygonal.

15. The structure of claim 14 wherein the voids in the web-deformable sustainers are distributed evenly along the length of the sustainers.

16. The structure of claim 14 wherein the voids in the web-deformable sustainers are located in close proximity to the ends of the sustainers.

* * * * *